US006470707B2

(12) United States Patent
Rottmann et al.

(10) Patent No.: US 6,470,707 B2
(45) Date of Patent: Oct. 29, 2002

(54) PROCESS FOR OBTAINING GASEOUS NITROGEN

(75) Inventors: Dietrich Rottmann; Christian Kunz, both of Munich (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/810,708

(22) Filed: Mar. 19, 2001

(65) Prior Publication Data

US 2001/0052242 A1 Dec. 20, 2001

(30) Foreign Application Priority Data

Mar. 17, 2000 (DE) ..... 100 13 074

(51) Int. Cl.[7] ..... F25J 3/04
(52) U.S. Cl. ..... 62/652
(58) Field of Search ..... 62/652, 901

(56) References Cited

U.S. PATENT DOCUMENTS

| | | | | |
|---|---|---|---|---|
| 4,400,188 A | | 8/1983 | Patel et al. | |
| 5,813,251 A | * | 9/1998 | Voit | 62/646 |
| 6,082,137 A | * | 7/2000 | Higginbotham | 62/652 |

FOREIGN PATENT DOCUMENTS

| | | |
|---|---|---|
| DE | 19623310 | 11/1996 |
| DE | 10013073 | 10/2000 |
| EP | 0816784 | 1/1998 |
| FR | 2767317 | 2/1999 |
| GB | 1392294 | 4/1975 |

* cited by examiner

*Primary Examiner*—William C. Doerrler
*Assistant Examiner*—Malik N. Drake
(74) *Attorney, Agent, or Firm*—Millen, White, Zelano & Branigan, P.C.

(57) ABSTRACT

For obtaining gaseous nitrogen by low-temperature separation from air, a distillation column system has a single column (4). Compressed air (1) is cooled in a main heat exchanger (2) and fed (3) to single column (4). A nitrogen-rich fraction (5, 7, 8) is drawn off from the distillation column system and compressed at least in part in a circulation compressor (9, 1063). A first part (12, 13) of nitrogen-rich fraction (5, 7, 8) is fed downstream from circulation compressor (9) to the liquefaction chamber of a condenser-evaporator (14) and is condensed under a pressure higher than the operating pressure of single column (4), so to form nitrogen-rich liquid (15, 16). A liquid oxygen-enriched fraction (231) from the distillation column system is at least partially evaporated in the evaporation chamber of condenser-evaporator (14). A first oxygen-enriched gas (234, 533) formed in the evaporation chamber of condenser-evaporator (14), is introduced into single column (4). A second portion (19, 20, 1064) of the nitrogen-rich fraction (5, 7, 8) is drawn off at least at times as gaseous nitrogen product. A second oxygen-enriched gas (221, 521) is removed from the evaporation chamber of condenser-evaporator (14), work expanded (23), and heated in main heat exchanger (2).

11 Claims, 1 Drawing Sheet

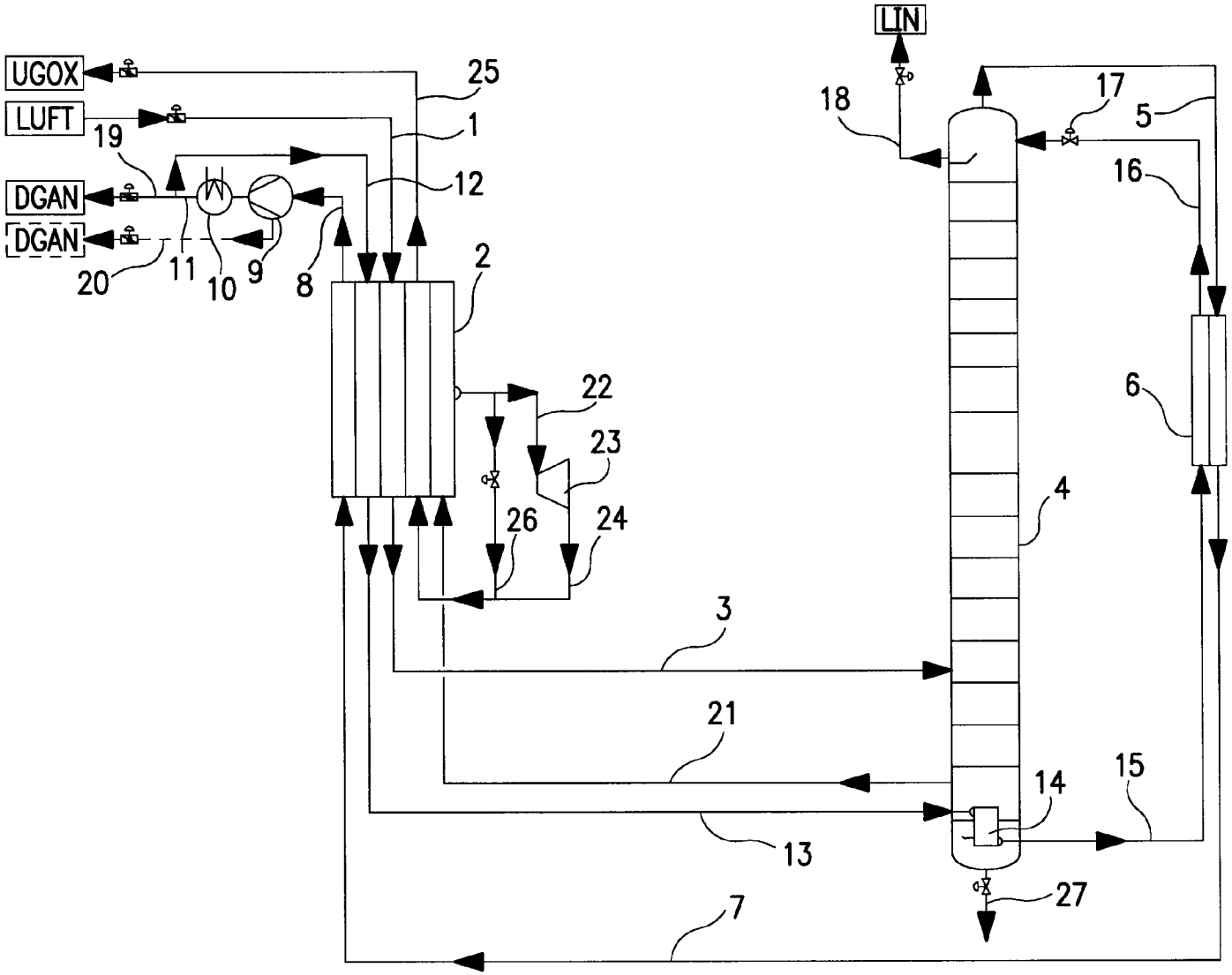
LIN
UGOX
LUFT
DGAN
DGAN
1
2
3
4
5
6
7
8
9
10
11
12
13
14
15
16
17
18
19
20
21
22
23
24
25
26
27

PROCESS FOR OBTAINING GASEOUS NITROGEN

CROSS-REFERENCE OF RELATED APPLICATION

This application is related to our concurrently filed application entitled "Process for Obtaining Gaseous and Liquid Nitrogen with a Variable Proportion of Liquid Products." Application No. 09/810,340 based on German Priority Application No. 10013075.5, filed Mar. 17, 2001.

This invention relates to a process for producing gaseous and liquid nitrogen with a variable proportion of liquid product by low-temperature separation of air in a distillation column system, said system being based on a single column rather than a connected double column.

Single-column processes are known for the production of nitrogen. In contrast to the double-column process, single-column system has only a high pressure column (the single column) and no conventional low-pressure column, the latter being normally operated with a reflux of a liquid nitrogen-containing stream and a feed of oxygen, both from the high pressure column. Nevertheless, the distillation column system of this invention may have additional columns beyond the single column, for example for obtaining ultra pure nitrogen or oxygen. Such additional columns do not require a liquid nitrogen reflux for the ultra pure oxygen column or an oxygen-containing stream for the nitrogen column.

The "distillation column system" comprises distillation columns that are connected to one another, but not the heat exchangers or machines such as compressors or expansion engines. In the simplest case, the distillation column system is formed exclusively by the single column.

"Oxygen-enriched" is defined here as a mixture of producer gases that has a higher oxygen concentration than air up to virtually pure oxygen. For example, oxygen-enriched fractions have an oxygen content of 25 to 90%, preferably 30 to 80%. (All percentages related here and below are molar percents, unless otherwise indicated.)

A single column distillation system including a nitrogen circuit is substantially disclosed in U.S. Pat. No. 4,400,188 as follows:

- compressed air is cooled in a main heat exchanger, and fed to single column;
- a nitrogen-rich fraction is drawn off from the distillation column system and is compressed, at least in part, in a circulation compressor;
- a first part of compound nitrogen-rich fraction is fed downstream from the circulation compressor to a liquefaction chamber of a condenser-evaporator and is condensed therein under a pressure higher than the operating pressure of the single column, thereby forming a nitrogen-rich liquid;
- a liquid, oxygen-enriched fraction is withdrawn from the distillation column system and is at least partially evaporated in an evaporation chamber of the condenser-evaporator;
- a first oxygen-enriched gas is withdrawn from the evaporation chamber and introduced into the single column, as ascending vapor; and
- a second part of the compressed nitrogen-rich fraction is withdrawn at least at times as gaseous nitrogen product.

A condenser-evaporator, which provides the bottom heating of the single column, is heated with the nitrogen which was brought to a level above column pressure in the circulation compressor. Process cold is produced by a conventional residual-gas turbine, which is operated with gas from another condenser-evaporator, a top condenser.

SUMMARY OF THE INVENTION

An object of the invention is to provide an energy-wise improved process of the above-mentioned type and a corresponding apparatus. Upon further study of the specification and appended claims, the object and advantages of the invention will become apparent.

To at least partially achieve these objects, a second oxygen-enriched gas is removed from the evaporation chamber of the condenser-evaporator, is machine expanded and is heated in the main heat exchanger.

The entire reflux liquid for the single column is preferably produced in the condenser-evaporator. In general, only a single condenser-evaporator is therefore necessary.

Air compressors and circulation compressors can be formed by a single machine, namely by a combi-machine, in which several pinion gears are arranged on a shaft, some of which form part of the air compressor and one or more form part of the circulation compressor.

The circulation compressor can be formed at least partially by a compressor that is coupled to the residual-gas turbine, whereby at least a portion of the mechanical energy that is produced in the machine expansion of the second oxygen-enriched gas is used for compression of the first portion and/or the second portion of the nitrogen-rich fraction.

In addition, the invention relates to a system comprising:

Apparatus for obtaining gaseous nitrogen by low-temperature separation from air with distillation column system comprising a single column (4), an air compressor, a main heat exchanger, passage means for feed air between the single column (4) from the air compressor through the main heat exchanger (2), a circulation compressor (9,1063) for compression of the first portion of a nitrogen-rich fraction (5, 7, 8) from the distillation column system, a circulation line (12, 13) from the outlet of circulation compressor (1063, 9) to a liquefaction chamber of a condenser-evaporator (14), means for feeding a liquid, oxygen-enriched fraction from the distillation column system to the evaporation chamber of condenser-evaporator (14), means for the production of a first oxygen-enriched gas (234, 533) from vapor (232) formed in the evaporation chamber of the condenser-evaporator (14) and for introduction into the single column (4) and a a gas production line for drawing off a second portion (19, 20, 1064) of nitrogen-rich fraction (5, 7, 8) as a gaseous nitrogen product, said apparatus further comprising:

a machine (23) for engine expanding a second oxygen-enriched gas (221, 521) from the evaporation chamber of condenser-evaporator (14), and conduits leading from said evaporation chamber to said machine.

BRIEF DESCRIPTION OF DRAWING

The attached drawing is a schematic representation of an embodiment of the invention.

DETAILED DESCRIPTION

The invention and further details of the invention are explained in more detail below based on an embodiment that is diagrammatically depicted in the drawing. In the process, compressed and purified feed air, which is under a pressure of about 3.5 bar, is brought in via a line 1. (Air compressors and air purification—for example using a molecular sieve—are not shown in the drawing). The air is cooled in a main heat exchanger 2 to approximately dewpoint and fed via line 3 to a single column 4 at an intermediate point. The intermediate point is, for example, 5 to 20 theoretical plates or actual plates above the bottom of column 4. The operating pressure at the bottom of the single column is 3.0 bar in the example.

Overhead nitrogen 5 (the "nitrogen-rich fraction") from single column 4 also contains 1 ppm to 1 ppb oxygen and is heated in a sub-cooler 6 and (line 7) further in main heat exchanger 2 to approximately ambient temperature. Warm overhead nitrogen 8 is fed to a circulation compressor 9, which has, for example, two to three stages. Behind each stage of the circulation compressor is secondary or intermediate cooling for removal of compression heat, of which, however, only secondary cooling 10 behind the final stage is shown in the drawing. A first portion 12 of overhead nitrogen 11 that is compressed to a pressure of 9.5 bar is fed back to main heat exchanger 2, cooled there to several Kelvin degrees above the column temperature and fed via line 13 to the liquefaction chamber of a condenser-evaporator 14. There, it is completely or almost completely liquefied under approximately the exhaust pressure of circulation compressor 9. Nitrogen-rich liquid 15 that is formed is sub-cooled in sub-cooler 6 and passed via line 16 and throttle valve 17 to the top of the single column. A portion 18 of nitrogen-rich liquid 16 can be drawn off as liquid nitrogen product LIN. As shown in the drawing, the liquid nitrogen is drawn off from the single column wherein the top of the column functions as a flash gas or phase separator between throttle valve 17 and liquid product drawn off conduit 18.

A second portion 19 of overhead nitrogen 11 compressed in circulation compressor 9 is withdrawn as gaseous nitrogen product under pressure (DGAN). As an alternative or in addition, a portion 20 of the compressed nitrogen as a gaseous compressed nitrogen product (DGAN') can be withdrawn from an intermediate stage of the circulation compressor at a pressure between the operating pressure of the single column 4 and the final pressure of circulation compressor 9. In both cases, the circulation compressor 9 is used simultaneously as a product compressor.

Condenser-evaporator 14 is placed directly in the bottom of the single column in the embodiment shown in the drawing. On the evaporation side, the oxygen-enriched bottom liquid of single column 4 evaporates under its operating pressure while forming vapor having an oxygen content of about 80%. While a first part of the vapor, produced in condenser-evaporator 14, rises ("first oxygen-enriched gas") in single column 4, a second part 21 ("second oxygen-enriched gas") is fed to the cold end of main heat exchanger 2. After being heated to an intermediate temperature, this second part flows via line 22 to a residual-gas turbine 23 and is work expanded from about 3 bar to about 1.5 bar. The resultant work expanded oxygen-enriched gas 24 is completely heated in main heat exchanger 2 and disposed of via line 25 as impure oxygen product UGOX. It can be used as regeneration gas in the air purification system, not shown, and/or as gaseous by-product and/or disposed of in the atmosphere. The rate of delivery of the second oxygen-enriched gas to the turbine 23 can be adjusted via a bypass 26. A small amount of liquid 27 is drained off continuously or intermittently as rinsing liquid from the evaporation chamber of condenser-evaporator 14.

Cold values are obtained by the work expansion of the second oxygen-enriched gas 21 from the evaporation chamber of condenser-evaporator 14.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding German application DE 10013074.7, filed Mar. 17, 2000, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A Process for obtaining gaseous nitrogen by low-temperature separation from air in a distillation column system, having a single column (4), comprising the following stages:

compressed air is cooled in a main heat exchanger, and fed to single column;

a nitrogen-rich fraction is drawn off from the distillation column system and is compressed, at least in part, in a circulation compressor;

a first part of compound nitrogen-rich fraction is fed downstream from the circulation compressor to a liquefaction chamber of a condenser-evaporator and is condensed therein under a pressure higher than the operating pressure of the single column, thereby forming a nitrogen-rich liquid;

a liquid, oxygen-enriched fraction is withdrawn from the distillation column system and is at least partially evaporated in an evaporation chamber of the condenser-evaporator;

a first oxygen-enriched gas is withdrawn from the evaporation chamber and introduced into the single column, as ascending vapor; and a second part of the compressed nitrogen-rich fraction is withdrawn at least at times as gaseous nitrogen product, and wherein a second oxygen-enriched gas is withdrawn from the evaporation chamber of the condenser-evaporator, is work expanded, and is heated in the main heat exchanger.

2. A process according to claim 1, wherein said nitrogen-rich liquid in the condenser-evaporator is passed to the single column, fulfilling entire reflux requirements for said single column.

3. A process for obtaining gaseous nitrogen by low-temperature separation from air in a distillation column system, having a single column (4), comprising the following stages:

compressed air is cooled in a main heat exchanger, and fed to single column;

a nitrogen-rich fraction is drawn off from the distillation column system and is compressed, at least in part, in a circulation compressor;

a first part of compound nitrogen-rich fraction is fed downstream from the circulation compressor to a liquefaction chamber of a condenser-evaporator and is condensed therein under a pressure higher than the operating pressure of the single column, thereby forming a nitrogen-rich liquid;

a liquid, oxygen-enriched fraction is withdrawn from the distillation column system and is at least partially evaporated in an evaporation chamber of the condenser-evaporator;

a first oxygen-enriched gas is withdrawn from the evaporation chamber and introduced into the single column, as ascending vapor; and a second part of the compressed nitrogen-rich fraction is withdrawn at least at times as gaseous nitrogen product, and wherein a second oxygen-enriched gas is withdrawn from the evaporation chamber of the condenser-evaporator, is work expanded, and is heated in the main heat exchanger, and wherein air compressors and circulation compressors (9) are formed by a single machine.

4. A process according to claim 1, wherein at least a portion of mechanical energy produced in work expanding the second oxygen-enriched gas is applied for compression (1063) of the first portion or the second portion of nitrogen-rich fraction (5, 7, 8), or for compression (1063) of the first portion and the second portion of nitrogen-rich fraction (5, 7, 8).

5. Apparatus for obtaining gaseous nitrogen by low-temperature separation from air with a distillation column system comprising a single column (4), an air compressor, a main heat exchanger, passage means for feed air, between the single column (4) from the air compressor through the main heat exchanger (2), a circulation compressor (9, 1063) for compression of the first portion of a nitrogen-rich fraction (5, 7, 8) from the distillation column system, a circulation line (12, 13), from the outlet of circulation compressor (1063, 9) to a liquefaction chamber of a condenser-evaporator (14), means for feeding a liquid, oxygen-enriched fraction from the distillation column system to the evaporation chamber of condenser-evaporator (14), means for the production of a first oxygen-enriched gas (234, 533) from vapor (232) formed in the evaporation chamber of the condenser-evaporator (14) and for introduction into the single column (4) and a a gas production line for drawing off a second portion (19, 20, 1064) of nitrogen-rich fraction (5, 7, 8) as a gaseous nitrogen product, said apparatus further comprising a machine (23) for engine expanding a second oxygen-enriched gas (221, 521) from the evaporation chamber of condenser-evaporator (14), and conduits leading from said evaporation chamber to said machine.

6. A process according to claim 1, wherein oxygen enriched fractions have an oxygen content of 25% to 90%.

7. A process according to claim 1, wherein oxygen enriched fractions have an oxygen content of 30% to 80%.

8. A process according to claim 1, wherein the pressure at the bottom of the single column is 3.0 bar.

9. A process according to claim 1, wherein the compressed air that is cooled in the heat main heat exchanger and is fed to the single column is under a pressure of 3.5 bar.

10. A process according to claim 1, wherein the compressed air that is cooled in the heat main heat exchanger and is fed to the single column is purified.

11. A process for obtaining gaseous nitrogen by low-temperature separation from air in a distillation column system, having a single column (4), comprising the following stages:

compressed air is cooled in a main heat exchanger, and fed to single column;

a nitrogen-rich fraction is drawn off from the distillation column system and is compressed, at least in part, in a circulation compressor;

a first part of compound nitrogen-rich fraction is fed downstream from the circulation compressor to a liquefaction chamber of a condenser-evaporator and is condensed therein under a pressure higher than the operating pressure of the single column, thereby forming a nitrogen-rich liquid;

a liquid, oxygen-enriched fraction is withdrawn from the distillation column system and is at least partially evaporated in an evaporation chamber of the condenser-evaporator;

a first oxygen-enriched gas is withdrawn from the evaporation chamber and introduced into the single column, as ascending vapor; and a second part of the compressed nitrogen-rich fraction is withdrawn at least at times as gaseous nitrogen product, and wherein a second oxygen-enriched gas is withdrawn from the evaporation chamber of the condenser-evaporator, is work expanded, and is heated in the main heat exchanger, and wherein the second oxygen-enriched gas is disposed of in the atmosphere or is used as regeneration gas in an air purification system or is used as gaseous by-product.

* * * * *